US006190533B1

(12) United States Patent
Bradow et al.

(10) Patent No.: US 6,190,533 B1
(45) **Date of Patent: *Feb. 20, 2001**

(54) INTEGRATED HYDROTREATING STEAM CRACKING PROCESS FOR THE PRODUCTION OF OLEFINS

(75) Inventors: Carl W. Bradow, Pearland; Dane Clark Grenoble, Nassau Bay; Stanley N. Milam, Houston; Bruce H. C. Winquist, Houston; Brendan D. Murray, Houston; Richard M. Foley, Houston, all of TX (US)

(73) Assignee: Exxon Chemical Patents Inc., Houston, TX (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/848,438

(22) Filed: May 8, 1997

Related U.S. Application Data

(60) Provisional application No. 60/027,859, filed on Aug. 15, 1996, and provisional application No. 60/034,612, filed on Dec. 31, 1996.

(51) Int. Cl.[7] ..... C10G 69/06; C07C 4/04

(52) U.S. Cl. ..... 208/57; 208/61; 208/89; 585/251; 585/648; 585/649; 585/650

(58) Field of Search ..... 208/57, 89, 61, 208/210, 212; 585/251, 648, 649, 650

(56) References Cited

U.S. PATENT DOCUMENTS

| | | | | |
|---|---|---|---|---|
| 3,293,192 | | 12/1966 | Maher et al. | 252/430 |
| 3,449,070 | | 6/1969 | McDaniel et al. | 23/111 |
| 3,511,771 | * | 5/1970 | Hamner | 208/89 |
| 3,617,501 | * | 11/1971 | Eng et al. | 208/89 |
| 3,644,197 | * | 2/1972 | Kelley et al. | 208/89 |
| 3,855,113 | * | 12/1974 | Gould | 208/89 |
| 3,898,299 | * | 8/1975 | Jones | 208/89 |
| 3,907,920 | * | 9/1975 | Starks | 585/251 |
| 4,180,453 | * | 12/1979 | Franck et al. | 208/57 |
| 4,188,281 | * | 2/1980 | Wernicke et al. | 208/89 |
| 4,446,004 | * | 5/1984 | Chen et al. | 208/57 |
| 4,447,314 | * | 5/1984 | Banta | 208/89 |
| 4,619,757 | | 10/1986 | Zimmermann | 208/57 |
| 4,960,505 | | 10/1990 | Minderhoud et al. | 208/143 |
| 5,391,291 | | 2/1995 | Winquist et al. | 208/143 |
| 5,472,928 | * | 12/1995 | Scheuerman et al. | 502/305 |

* cited by examiner

*Primary Examiner*—Walter D. Griffin
(74) *Attorney, Agent, or Firm*—Linda K. Russell

(57) ABSTRACT

An integrated process for converting a hydrocarbon feedstock having components boiling above about 100° C. into steam cracked products is described. The process first involves passing the feedstock to a hydrotreating zone at a pressure in the range of from about 400 psig to about 1,250 psig to effect substantially complete decomposition of organic sulfur and/or nitrogen compounds. The product from the hydrotreating zone is passed to a steam cracking zone. Hydrogen and $C_1$–$C_4$ hydrocarbons, steam cracked naphtha, steam cracked gas oil and steam cracked tar are recovered, where the amount of steam cracked tar produced is reduced by at least about 15 percent, basis the starting hydrocarbon feedstock which has not been subject to hydrotreating.

23 Claims, No Drawings

INTEGRATED HYDROTREATING STEAM CRACKING PROCESS FOR THE PRODUCTION OF OLEFINS

This application claims the benefit of the filing U.S. Provisional Patent Applications No. 60/027,859, filed Aug. 15, 1996 and 60/034,612, filed Dec. 31, 1996, relating to the hydrocarbon conversion process.

FIELD OF THE INVENTION

This invention relates to a process for upgrading hydrocarbon feedstocks for subsequent use in steam cracking. In particular, this invention describes a process for upgrading hydrocarbon feedstocks for use in steam cracking by the application of hydrotreating and concomitant partial hydrogenation of the unsaturated and/or aromatic species found therein, and the resultant yield increase of hydrogen, $C_1$–$C_4$ hydrocarbons, steam cracked naphtha and steam cracked gas oil, and the concomitant decrease in the yield of steam cracked gas tar, upon steam cracking of the hydrotreated hydrocarbon feedstocks.

BACKGROUND OF THE INVENTION

Steam cracking is a process widely known in the petrochemical art. The primary intent of the process is the production of $C_1$–$C_4$ hydrocarbons, particularly ethylene, propylene, and butadiene, by thermal cracking of hydrocarbon feedstocks in the presence of steam at elevated temperatures. The steam cracking process in general has been well described in the publication entitled "Manufacturing Ethylene" by S. B. Zdonik et. al, Oil and Gas Journal Reprints 1966–1970. Typical liquid feedstocks for conventional steam crackers are straight run (virgin) and hydrotreated straight run (virgin) feedstocks ranging from light naphthas to vacuum gas oils. Gaseous feedstocks such as ethane, propane and butane are also commonly processed in the steam cracker.

The selection of a feedstock for processing in the steam cracker is a function of several criteria including: (i) availability of the feedstock, (ii) cost of the feedstock and (iii) the yield slate derived by steam cracking of that feedstock. Feedstock availability and cost are predominantly a function of global supply and demand issues. On the other hand, the yield slate derived by steam cracking of a given feedstock is a function of the chemical characteristics of that feedstock. In general, the yield of high value $C_1$–$C_4$ hydrocarbons, particularly ethylene, propylene and butadiene, is greatest when the steam cracker feedstocks are gaseous feedstocks such as ethane, propane and butane. The yield of high value steam cracked naphtha and low value steam cracked gas oil (SCGO) and particularly low value steam cracked tar (SCT) upon steam cracking of a straight run (virgin) or hydrotreated straight run (virgin) feedstocks increases as the boiling range of the feedstock increases. Thus, the steam cracking of liquid feedstocks such as naphthas, gas oils and vacuum gas oils generally results in a greater proportion of particularly low value steam cracked products, i.e., steam cracked tar. In addition, steam cracking facilities where naphthas and gas oils are processed require additional capital infrastructure in order to process the large volume of liquid co-products resulting from steam cracking of those feedstocks.

What is more, the yield of the least desirable products of steam cracking, steam cracked tar, is generally even higher when low quality hydrogen deficient cracked feedstocks such as thermally cracked naphtha, thermally cracked gas oil, catalytically cracked naphtha, catalytically cracked gas oil, coker naphthas and coker gas oil are processed. The significantly increased yield of the low value steam cracked tar product relative to production of high value $C_1$–$C_4$ hydrocarbon products obtained when processing the low quality hydrogen deficient cracked feedstocks is such that these feedstocks are rarely processed in steam crackers.

Catalytic hydrodesulfurization (sulfur removal), hydrodenitrification (nitrogen removal) and hydrogenation (olefins, diolefins and aromatics saturation) are well known in the petroleum refining art. Hydrodesulfurization, hydrodenitrification and partial hydrogenation have been applied to upgrading feedstocks for steam cracking as described by Zimmermann in U.S. Pat. No. 4,619,757. This two stage approach employed base metal, bi-metallic catalysts on both non-acidic (alumina) and acidic (zeolite) supports.

Minderhoud et. al., U.S. Pat. No. 4,960,505, described an approach for upgrading of kerosene and fuel oil feedstocks by first pre-treating the feedstock to effect hydrodesulfurization and hydrodenitrification to yield a liquid product with sulfur and nitrogen contaminants at levels of less than 1,000 and 50 ppm wt., respectively. Thereafter, the low impurity hydrocarbon stream was subjected to hydrogenation to yield a high cetane number fuel oil product.

Winquist et. al., U.S. Pat. No. 5,391,291, described an approach for upgrading of kerosene, fuel oil, and vacuum gas oil feedstocks by first pre-treating the feedstock to effect hydrodesulfurization and hydrodenitrification, and thereafter hydrogenation of the resultant liquid hydrocarbon fraction to yield a high cetane number fuel oil product.

It has been found that the present invention which comprises hydrotreating followed by steam cracking results in significant yield improvements for hydrogen, $C_1$–$C_4$ hydrocarbons and steam cracked naphtha when applied to straight run (virgin) feedstocks; and results in high yields of hydrogen, $C_1$–$C_4$ hydrocarbons and steam cracked naphtha and reduced yields of steam cracked tar when applied to low quality, hydrogen deficient, cracked feedstocks such as thermally cracked naphtha, thermally cracked kerosene, thermally cracked gas oil, catalytically cracked naphtha, catalytically cracked kerosene, catalytically cracked gas oil, coker naphthas, coker kerosene, coker gas oil, steam cracked naphthas and steam cracked gas oils. The ability of this process to treat low quality hydrogen deficient cracked feedstocks, such as steam cracked gas oil, permits these heretofore undesirable feedstocks to be recycled to extinction through the combined feedstock upgrading and steam cracking system.

It has further been found that hydrogen, $C_1$–$C_4$ hydrocarbons and steam cracked naphtha can be produced in higher quantities in a process in which the effluent from at least one hydrotreating zone containing at least two hydrotreating catalysts is passed to a steam cracking zone. The effluents from the steam cracking zone are then passed to one or more fractionating zones in which the effluents are separated into a fraction comprising hydrogen and $C_1$–$C_4$ hydrocarbons, a steam cracked naphtha fraction, a steam cracked gas oil fraction and a steam cracked tar fraction. The process of the present invention results in improved yields of the high value steam cracked products, i.e., $C_1$–$C_4$ hydrocarbons, particularly ethylene, propylene, and butadiene, and steam cracked naphtha, particularly isoprene, cis-pentadiene, trans-pentadiene, cyclopentadiene, and benzene, and reduced yields of steam cracked tar.

SUMMARY OF THE INVENTION

This invention provides an integrated process for converting a hydrocarbon feedstock having components boiling above 100° C. into steam cracked products comprising hydrogen, $C_1$–$C_4$ hydrocarbons, steam cracked naphtha (boiling from $C_5$ to 220° C.), steam cracked gas oil (boiling from 220° C. to 275° C.) and steam cracked tar (boiling above 275° C.).

The process of the present invention therefore comprises: (i) passing the hydrocarbon feedstock through at least one hydrotreating zone wherein said feedstock is contacted at an elevated temperature and at a pressure in the range of from about 400 psig to about 1,250 psig with a hydrogen source and at least two hydrotreating catalysts to effect substantially complete conversion of organic sulfur and/or nitrogen compounds contained therein to $H_2S$ and $NH_3$, respectively; (ii) passing the product from said hydrotreating zone to a product separation zone to remove gases and, if desired, light hydrocarbon fractions; (iii) passing the product from said separation zone to a steam cracking zone and thereafter; (iv) passing the product from said steam cracking zone to one or more product separation zones to separate the product into a fraction comprising hydrogen and $C_1$–$C_4$ hydrocarbons, a steam cracked naphtha fraction, a steam cracked gas oil fraction and a steam cracked tar fraction, wherein the yields of ethylene and propylene and butadiene in the $H_2$ and $C_1$–$C_4$ hydrocarbons fraction are each increased by at least about 5 percent, relative to the yields obtained when the untreated hydrocarbon feedstock is subjected to said steam cracking and product separation, the yield of isoprene, cis-pentadiene, trans-pentadiene, cyclopentadiene and benzene in the steam cracked naphtha fraction are each increased by at least about 10 percent, relative to when the untreated hydrocarbon feedstock is subjected to said steam cracking and product separation, the yield of steam cracked gas oil is increased by at least about 20 percent, relative to when the untreated hydrocarbon feedstock is subjected to said steam cracking and product separation, and the yield of steam cracked tar is reduced by at least about 15 percent, relative to when the untreated hydrocarbon feedstock is subjected to said steam cracking and product separation.

DESCRIPTION OF THE PREFERRED EMBODIMENTS

As used in this specification, the term "$C_1$–$C_4$ hydrocarbons" refers to methane, ethane, ethylene, acetylene, propane, propylene, propadiene, methylacetylene, butane, isobutane, isobutylene, butene-1, cis-butene-2, trans-butene-2, butadiene, and $C_4$-acetylenes. As used in this specification, the term "steam cracked naphtha" refers to products boiling between $C_5$ and 220° C., including isoprene, cis-pentadiene, trans-pentadiene, cyclopentadiene, methylcyclopentadiene, and benzene.

The hydrocarbon feedstock in the process of the present invention typically comprises a hydrocarbon fraction having a major proportion, i.e., greater than about 95 percent, of its components boiling above about 100° C., preferably above about 150° C. or higher. Suitable feedstocks of this type include straight run (virgin) naphtha, cracked naphthas (e.g. catalytically cracked, steam cracked, and coker naphthas and the like), straight run (virgin) kerosene, cracked kerosenes (e.g. catalytically cracked, steam cracked, and coker kerosenes and the like), straight run (virgin) gas oils (e.g. atmospheric and vacuum gas oil and the like), cracked gas oils (e.g. coker and catalytically cracked light and heavy gas oils, steam cracked gas oils and the like) visbreaker oil, deasphalted oil, thermal cracker cycle oil, synthetic gas oils and coal liquids. Normally the feedstock will have an extended boiling range, e.g., up to 650° C. or higher, but may be of more limited ranges with certain feedstocks. In general, the feedstocks will have a boiling range between about 150° C. and about 650° C.

In the hydrotreating zone, the hydrocarbon feedstock and a hydrogen source are contacted with at least two hydrotreating catalysts to effect substantially complete decomposition of organic sulfur and/or nitrogen compounds in the feedstock, i.e., organic sulfur levels below about 100 parts per million, preferably below about 50 parts per million, and more preferably below about 25 parts per million, and organic nitrogen levels below about 15 parts per million, preferably below about 5 parts per million, and more preferably below about 3 parts per million. The source of hydrogen will typically be hydrogen-containing mixtures of gases which normally contain about 70 volume percent to about 100 volume percent hydrogen.

In one embodiment, the hydrotreating zone contains two hydrotreating catalysts in a stacked bed or layered arrangement. When a stacked bed catalyst configuration is utilized, the first hydrotreating catalyst typically comprises one or more Group VIB and/or Group VIII (Periodic Table of the Elements) metal compounds supported on an amorphous carrier such as alumina, silica-alumina, silica, zirconia or titania. Examples of such metals comprise nickel, cobalt, molybdenum and tungsten. The first hydrotreating catalyst is preferably an oxide and/or sulfide of a Group VIII metal, preferably cobalt or nickel, mixed with an oxide and/or a sulfide of a Group VIB metal, preferably molybdenum or tungsten, supported on alumina or silica-alumina. The second hydrotreating catalyst typically comprises one or more Group VIB and/or Group VIII metal components supported on an acidic porous support. From Group VIB, molybdenum, tungsten and mixtures thereof are preferred. From Group VIII, cobalt, nickel and mixtures thereof are preferred. Preferably, both Group VIB and Group VIII metals are present. In a particularly preferred embodiment, the hydrotreating component of the second hydrotreating catalyst is nickel and/or cobalt combined with tungsten and/or molybdenum with nickel/tungsten or nickel/molybdenum being particularly preferred. With respect to the second hydrotreating catalyst, the Group VIB and Group VIII metals are supported on an acidic carrier, such as, for example, silica-alumina, or a large pore molecular sieve, i.e. zeolites such as zeolite Y, particularly, ultrastable zeolite Y (zeolite USY), or other dealuminated zeolite Y. Mixtures of the porous amorphous inorganic oxide carriers and the molecular sieves can also be used. Typically, both the first and second hydrotreating catalysts in the stacked bed arrangement are sulfided prior to use.

The hydrotreating zone is typically operated at temperatures in the range of from about 200° C. to about 550° C., preferably from about 250° C. to about 500° C., and more preferably from about 275° C. to about 425° C. The pressure in the hydrotreating zone is generally in the range of from about 400 psig to about 1,250 psig, preferably from about 400 psig to about 1,000 psig, and more preferably from about 400 psig to about 750 psig. Liquid hourly space velocities (LHSV) will typically be in the range of from about 0.1 to about 10, preferably from about 0.5 to about 5 volumes of liquid hydrocarbon per hour per volume of catalyst, and hydrogen to oil ratios will be in the range of from about 500 to about 10,000 standard cubic feet of hydrogen per barrel of feed (SCF/BBL), preferably from about 1,000 to about 5,000 SCF/BBL, most preferably from about 2,000 to about 3,000 SCF/BBL. These conditions are adjusted to achieve substantially complete desulfurization and denitrification, i.e., organic sulfur levels below about 100 parts per million, preferably below about 50 parts per million, and more preferably below about 25 parts per million, and organic nitrogen levels below about 15 parts per million, preferably below about 5 parts per million, and more preferably below about 3 parts per million.

Alternatively, the hydrotreating step may be carried out utilizing two or more hydrotreating zones. For example, in one embodiment, the hydrotreating step can be carried out in the manner described below in which two zones, a first hydrotreating zone and a second hydrotreating zone, are used.

In the first hydrotreating zone, the hydrocarbon feedstock and a hydrogen source are contacted with a first hydrotreating catalyst. The source of hydrogen will typically be hydrogen-containing mixtures of gases which normally contain about 70 volume percent to about 100 volume percent hydrogen. The first hydrotreating catalyst will typically include one or more Group VIB and/or Group VIII metal compounds on an amorphous carrier such as alumina, silica-alumina, silica, zirconia or titania. Examples of such metals comprise nickel, cobalt, molybdenum and tungsten. The first hydrotreating catalyst is preferably an oxide and/or sulfide of a Group VIII metal, preferably cobalt or nickel, mixed with an oxide and/or a sulfide of a Group VIB metal, preferably molybdenum or tungsten, supported on alumina or silica-alumina. The catalysts are preferably in sulfided form.

The first hydrotreating zone is generally operated at temperatures in the range of from about 200° C. to about 550° C., preferably from about 250° C. to about 500° C., and more preferably from about 275° C. to about 425° C. The pressure in the first hydrotreating zone is generally in the range of from about 400 psig to about 1,250 psig, preferably from about 400 psig to about 1,000 psig, and more preferably from about 400 psig to about 750 psig. Liquid hourly space velocities (LHSV) will typically be in the range of from about 0.2 to about 2, preferably from about 0.5 to about 1 volumes of liquid hydrocarbon per hour per volume of catalyst, and hydrogen to oil ratios will be in the range of from about 500 to about 10,000 standard cubic feet of hydrogen per barrel of feed (SCF/BBL), preferably from about 1,000 to about 5,000 SCF/BBL, most preferably from about 2,000 to about 3,000 SCF/BBL. These conditions are adjusted to achieve the desired degree of desulfurization and denitrification. Typically, it is desirable in the first hydrotreating zone to reduce the organic sulfur level to below about 500 parts per million, preferably below about 200 parts per million, and the organic nitrogen level to below about 50 parts per million, preferably below about 25 parts per million.

The product from the first hydrotreating zone may then, optionally, be passed to a means whereby ammonia and hydrogen sulfide are removed from the hydrocarbon product by conventional means. The hydrocarbon product from the first hydrotreating zone is then sent to a second hydrotreating zone. Optionally, the hydrocarbon product may also be passed to a fractionating zone prior to being sent to the second hydrotreating zone if removal of light hydrocarbon fractions is desired.

In the second hydrotreating zone, the product from the first hydrotreating zone and a hydrogen source, typically hydrogen, about 70 volume percent to about 100 volume percent, in admixture with other gases, are contacted with at least one second hydrotreating catalyst. The operating conditions normally used in the second hydrotreating reaction zone include a temperature in the range of from about 200° C. to about 550° C., preferably from about 250° C. to about 500° C., and more preferably, from about 275° C. to about 425° C., a liquid hourly space velocity (LHSV) of about 0.1 to about 10 volumes of liquid hydrocarbon per hour per volume of catalyst, preferably an LHSV of about 0.5 to about 5, and a total pressure within the range of about 400 psig to about 1,250 psig, preferably from about 400 psig to about 1,000 psig, and more preferably from about 400 psig to about 750 psig. The hydrogen circulation rate is generally in the range of from about 500 to about 10,000 standard cubic feet per barrel (SCF/BBL), preferably from about 1,000 to 5,000 SCF/BBL, and more preferably from about 2,000 to 3,000 SCF/BBL. These conditions are adjusted to achieve substantially complete desulfurization and denitrification. Typically, it is desirable that the hydrotreated product obtained from the hydrotreating zone or zones have an organic sulfur level below about 100 parts per million, preferably below about 50 parts per million, and more preferably below about 25 parts per million, and an organic nitrogen level below about 15 parts per million, preferably below about 5 parts per million and more preferably below about 3 parts per million. It is understood that the severity of the operating conditions is decreased as the volume of the feedstock and/or the level of nitrogen and sulfur contaminants to the second hydrotreating zone is decreased. For example, if product gases, including $H_2S$ and $NH_3$ (ammonia), and, optionally, light hydrocarbon fractions are removed after the first hydrotreating zone, then the temperature in the second hydrotreating zone will be lower, or alternatively, the LHSV in the second hydrotreating zone will be higher.

The catalysts typically utilized in the second hydrotreating zone comprise an active metals component supported on an acidic porous support. The active metal component, "the hydrotreating component", of the second hydrotreating catalyst is selected from a Group VIB and/or a Group VIII metal component. From Group VIB, molybdenum, tungsten and mixtures thereof are preferred. From Group VIII, cobalt, nickel and mixtures thereof are preferred. Preferably, both Group VIB and Group VIII metals are present. In a particularly preferred embodiment, the hydrotreating component is nickel and/or cobalt combined with tungsten and/or molybdenum with nickel/tungsten or nickel/molybdenum being particularly preferred. The components are typically present in the sulfide form.

The Group VIB and Group VIII metals are supported on an acidic carrier. Two main classes of carriers known in the art are typically utilized: (a) silica-alumina, and (b) the large pore molecular sieves, i.e. zeolites such as Zeolite Y, Mordenite, Zeolite Beta and the like. Mixtures of the porous amorphous inorganic oxide carriers and the molecular sieves are also used. The term "silica-alumina" refers to non-zeolitic aluminosilicates.

The most preferred support comprises a zeolite Y, preferably a dealuminuated zeolite Y such as an ultrastable zeolite Y (zeolite USY). The ultrastable zeolites used herein are well known to those skilled in the art. They are also exemplified in U.S. Pat. Nos. 3,293,192 and 3,449,070, the teachings of which are incorporated herein by reference. They are generally prepared from sodium zeolite Y by dealumination.

The zeolite is composited with a binder selected from alumina, silica, silica-alumina and mixtures thereof. Preferably the binder is alumina, preferably a gamma alumina binder or a precursor thereto, such as an alumina hydrogel, aluminum trihydroxide, aluminum oxyhydroxide or pseudoboehmite.

The Group VIB/Group VIII second hydrotreating catalysts are preferably sulfided prior to use in the second hydrotreating zone. Typically, the catalysts are sulfided by heating the catalysts to elevated temperatures (e.g., 200–400° C.) in the presence of hydrogen and sulfur or a sulfur-containing material.

The product from the final hydrotreating zone is then passed to a steam cracking, i.e., pyrolysis, zone. Prior to being sent to the steam cracking zone, however, if desired, the hydrocarbon product from the final hydrotreating zone may be passed to a fractionating zone for removal of product gases, and light hydrocarbon fractions.

In the steam cracking zone, the product from the hydrotreating zone and steam are heated to cracking temperatures. The operating conditions of the steam cracking zone normally include a coil outlet temperature greater than about 700° C., in particular between about 700° C. and 925° C., and preferably between about 750° C. and about 900° C., with steam present at a steam to hydrocarbon weight ratio in the range of from about 0.1:1 to about 2.0:1. The coil outlet pressure in the steam cracking zone is typically in the range of from about 0 psig to about 75 psig, preferably in the range of from about 0 psig to about 50 psig. The residence time for the cracking reaction is typically in the range of from about 0.01 second to about 5 seconds and preferably in the range of from about 0.1 second to about 1 second.

After the starting hydrocarbon feed has been subjected to a hydrotreating step and a steam cracking step, the effluent from the steam cracking step may be sent to one or more fractionating zones wherein the effluent is separated into a fraction comprising hydrogen and $C_1$–$C_4$ hydrocarbons, a steam cracked naphtha fraction boiling from $C_5$ to about 220° C., a steam cracked gas oil fraction boiling in the range of from about 220° C. to about 275° C. and a steam cracked tar fraction boiling above about 275° C. The amount of the undesirable steam cracked product, i.e., steam cracked tar, obtained utilizing the process of the present invention is greatly reduced. The yield of steam cracked tar is reduced by at least about 15 percent, relative to that obtained when the untreated hydrocarbon feedstock is subjected to steam cracking and product separation.

The process according to the present invention may be carried out in any suitable equipment. The hydrotreating zone or zones in the present invention typically comprise one or more vertical reactors containing at least one catalyst bed and are equipped with a means of injecting a hydrogen source into the reactors. A fixed bed hydrotreating reactor system wherein the feedstock is passed over one or more stationary beds of catalyst in each zone is particularly preferred.

The ranges and limitations provided in the instant specification and claims are those which are believed to particularly point out and distinctly claim the instant invention. It is, however, understood that other ranges and limitations that perform substantially the same function in substantially the same manner to obtain the same or substantially the same result are intended to be within the scope of the instant invention as defined by the instant specification and claims.

The invention will now be described by the following examples which are illustrative and are not intended to be construed as limiting the scope of the invention.

ILLUSTRATIVE EMBODIMENT 1

Example 1 and Comparative Example 1-A below were each carried out using a 100% Heavy Atmospheric Gas Oil (HAGO) feedstock having the properties shown in Table 1 below. Example 1 illustrates the process of the present invention. Comparative Example 1-A illustrates HAGO which has not been subjected to hydrotreating prior to steam cracking.

EXAMPLE 1

Example 1 describes the process of the present invention using a 100% Heavy Atmospheric Gas Oil (HAGO) feed having the properties shown in Table 1 below was hydrotreated using two hydrotreating catalysts in a stacked bed system as follows.

A commercial alumina supported nickel/molybdenum catalyst, available under the name of KF-756 from Akzo Chemicals Inc., U.S.A., was used as the first hydrotreating catalyst (catalyst A) while a commercial zeolite nickel/tungsten catalyst, available under the name of Z-763 from Zeolyst International, was used as the second hydrotreating catalyst (catalyst B).

Catalysts A and B catalysts were operated as a "stacked bed" wherein the HAGO and hydrogen contacted catalyst A first and thereafter catalyst B, with the volume ratio of the catalysts (A:B) being 1:1. The HAGO was hydrotreated at 360° C. (675° F.), 585 psig total unit pressure, an overall LHSV of 0.5 $hr^{-1}$ and a hydrogen flow rate of 3,000 SCF/BBL.

The hydrotreated product was then passed to the steam cracking zone where it was contacted with steam at a temperature of 745 to 765° C., a pressure of 13 to 25.5 psig, and a steam to hydrocarbon weight ratio of 0.3:1 to 0.45:1. The residence time in the steam cracker was 0.4 to 0.6 seconds. The steam cracked product was then sent to a fractionating zone to quantify total hydrogen ($H_2$) and $C_1$–$C_4$ hydrocarbons, steam cracked naphtha (SCN), steam cracked gas oil (SCGO), and steam cracked tar (SCT). The steam cracking results are presented in Table 3 below.

Comparative Example 1-A

A 100% Heavy Atmospheric Gas Oil (HAGO) feed was treated in the same manner as forth in Example 1 above, except that it was not subjected to hydrotreating prior to steam cracking. The steam cracking results are presented in Table 3 below.

TABLE 1

Properties of HAGO Feed (Comp. Ex. 1-A) and Hydrotreated HAGO (Ex. 1)

| | HAGO Feed (1-A) | Hydrotreated HAGO (Ex. 1) |
|---|---|---|
| wt. % H | 12.76 | 13.47 |
| ppm wt. S | 12,400 | 41 |
| ppm wt. N | 426 | 1 |
| Density, G/cm$^3$ @ 15° C. | 0.8773 | 0.8242 |
| Simulated Distillation, D-2887 (ASTM), ° C. | | |
| IBP | 99 | 37 |
| 5% | 200 | 99 |
| 10% | 238 | 124 |
| 30% | 304 | 200 |
| 50% | 341 | 261 |
| 70% | 374 | 337 |
| 90% | 421 | 389 |
| 95% | 443 | 413 |
| FBP | 491 | 485 |

HAGO feed (Comparative Example 1-A) and hydrotreated HAGO (Example 1) were analyzed by GC-MS in order to determine the structural types of the hydrocarbons present. These results are shown in Table 2 below. The results clearly show that the process of the present invention (Example 1) is effective at reducing the aromatic content of hydrocarbon feed streams with a concomitant rise in the quantity of both paraffins/isoparaffins and naphthenes.

TABLE 2

Molecular Structural Types Observed in HAGO, HT-HAGO, Hydrotreated HAGO and Distilled Saturated HT-HAGO

| Relative Abundance of Various Molecular Types, Vol. % | HAGO (1-A) | Hydrotreated HAGO (Ex. 1) |
|---|---|---|
| Paraffins/Isoparaffins | 27.69 | 28.70 |
| Naphthenes | 38.87 | 41.29 |
| Aromatics | 33.46 | 30.00 |

TABLE 3

Laboratory Steam Cracking Yields for Gaseous Products, Naphtha, Gas Oil, and Tar

| Product Yield, wt. % Based on Feedstock | HAGO (1-A) | Hydrotreated HAGO (Ex. 1) |
|---|---|---|
| Total $H_2$ and $C_1$–$C_4$ Hydrocarbons | 48.73 | 52.66 |
| Total Others, $C_5$ and Greater | 51.27 | 47.34 |
| SCN, $C_5$-220° C. (430° F.) | 23.54 | 29.50 |
| SCGO, 220–275° C. (430–525° F.) | 4.83 | 6.06 |
| SCT, 275° C. (526° F.) and Above | 22.90 | 11.78 |
| Total | 100.0 | 100.0 |
| Selected Gaseous Products | | |
| Hydrogen | 0.39 | 0.46 |
| Methane | 7.64 | 8.02 |
| Ethane | 4.03 | 3.91 |
| Ethylene | 14.39 | 16.54 |
| Acetylene | 0.06 | 0.07 |
| Propane | 0.72 | 0.62 |
| Propylene | 12.06 | 12.80 |
| Propadiene & Methylacetylene | 0.18 | 0.18 |
| Butane & Isobutane | 0.13 | 0.16 |
| Isobutylene | 1.88 | 2.16 |
| Butene-1 | 2.21 | 2.72 |
| Butadiene-1,3 | 3.32 | 3.74 |
| Butene-2 (cis & trans) | 1.25 | 1.27 |
| $C_4$ acetylenes | 0.01 | 0.01 |
| Selected Liquid Products | | |
| Isoprene | 0.89 | 1.08 |
| Pentadiene (cis & trans) | 0.74 | 0.95 |
| Cyclopentadiene | 1.19 | 1.48 |
| Methylcyclopentadiene | 0.81 | 1.06 |
| Benzene | 3.35 | 3.88 |

As can be seen in Table 3 above, the yield of each of the particularly valuable steam cracked mono- and diolefin products in the $H_2$ and $C_1$–$C_4$ hydrocarbons fraction, i.e., ethylene, propylene, and butadiene, is increased by at least about 6.0 percent, the yield of each of the valuable steam cracked diolefin and aromatic products in the steam cracked naphtha fraction, i.e., isoprene, cis-pentadiene, trans-pentadiene, cyclopentadiene, and benzene, is increased by at least about 15 percent, the yield of the steam cracked gas oil product is increased by about 25 percent and the yield of the low value steam cracked tar product is decreased by about 48 percent when the process of the present invention comprising hydrotreating and steam cracking (Example 1) is utilized relative to the yields obtained when the untreated hydrocarbon feed alone is subjected to steam cracking (Comparative Example 1-A).

ILLUSTRATIVE EMBODIMENT 2

Example 2 and Comparative Example 2-A below were each carried out using a 100% Catalytically Cracked Naphtha (CCN) feedstock having the properties shown in Table 4 below. Example 2 illustrates the process of the present invention. Comparative Example 2-A is illustrative of CCN which has not been subjected to hydrotreating prior to steam cracking.

EXAMPLE 2

Example 2 describes the process of the present invention using a 100% Catalytically Cracked Naphtha (CCN) feed.

A commercial alumina supported nickel/molybdenum catalyst (1/20" trilobe), available under the name of C-411 from Criterion Catalyst Company, was used as the first hydrotreating catalyst (catalyst A) while a commercial prototype hydroprocessing catalyst (1/8" cylinder), available under the name of HC-10 from Linde AG was used as the second hydrotreating catalyst (catalyst B).

The catalysts A and B were operated in the hydrotreating zone as a "stacked bed" wherein the feedstock and hydrogen were contacted with catalyst A first and thereafter with catalyst B; the volume ratio of the catalysts (A:B) in the hydrotreating zone was 2:1. The feed stock was hydrotreated at 370° C. (700° F.), 600 psig total unit pressure, an overall LHSV of 0.33 $hr^{-1}$ and a hydrogen flow rate of 2,900 SCF/BBL.

Hydrotreating of the CCN feed consumed 860 SCF/BBL of hydrogen and resulted in the production of 0.9 percent by weight of light gases (methane, ethane, propane and butane) and 2.5 percent by weight of liquid hydrocarbon boiling between $C_5$ and 150° C. (300° F.).

The hydrotreated CCN was then passed to the steam cracking zone where it was contacted with steam at a temperature of 790 to 805° C., a pressure of between 18.0 to 20.5 psig, and a steam to hydrocarbon weight ratio of 0.3:1 to 0.45:1. The residence time in the steam cracker was 0.4 to 0.6 seconds. The steam cracked product was then sent to a fractionating zone to quantify total hydrogen ($H_2$) and $C_1$–$C_4$) hydrocarbons, steam cracked naphtha (SCN), steam cracked gas oil (SCGO), and steam cracked tar (SCT). The steam cracking results are presented in Table 6 below.

Comparative Example 2-A

A 100% Catalytically Cracked Naphtha (CCN) feed was treated in the same manner as set forth in Example 2 above, except that it was not subjected to hydrotreating prior to steam cracking. The steam cracking results are presented in Table 6 below.

TABLE 4

Properties of CCN Feed (Comp. Ex. 2-A) and Hydrotreated CCN (Ex. 2)

| | CCN Feed (2-A) | Hydrotreated CCN (Ex. 2) |
|---|---|---|
| wt. % C | 89.15 | 88.31 |
| wt. % H | 10.31 | 11.78 |
| ppm wt. S | 4,130 | 2 |

TABLE 4-continued

Properties of CCN Feed (Comp. Ex. 2-A) and Hydrotreated CCN (Ex. 2)

| | CCN Feed (2-A) | Hydrotreated CCN (Ex. 2) |
|---|---|---|
| ppm wt. N | 217 | <1 |
| Density, g/cm³ @ 15° C. | 0.9071 | 0.8714 |
| Simulated Distillation, D-2887 (ASTM), ° C. | | |
| IBP | 189 | 75 |
| 5% | 202 | 161 |
| 10% | 205 | 183 |
| 30% | 212 | 204 |
| 50% | 221 | 212 |
| 70% | 230 | 223 |
| 90% | 236 | 235 |
| 95% | 242 | 244 |
| FBP | 376 | 341 |

CCN Feed (Comparative Example 2-A) and the hydrotreated CCN (Example 2) were analyzed by GC-MS in order to determine the structural types of the hydrocarbons present. These results are shown in Table 5 below. As can be seen in Table 5, the process of the present invention (Example 2) is effective at reducing the aromatic content of hydrocarbon feed streams with a concomitant rise in the quantity of both paraffins/isoparaffins and naphthenes.

TABLE 5

Molecular Structural Types Observed in CCN Feed (Comp. Ex. 2-A) and Hydrotreated CCN (EX. 2)

| Relative Abundance of Various Molecular Types, Vol. % | CCN Feed (2-A) | Hydrotreated CCN (Ex. 2) |
|---|---|---|
| Paraffins/Isoparaffins | 7.97 | 10.92 |
| Naphthenes | 5.19 | 26.79 |
| Aromatics | 86.83 | 62.27 |

TABLE 6

Laboratory Steam Cracking Yields for Gaseous Products Naphtha, Gas Oil, and Tar

| Product Yield wt. % Based on Feedstock | CCN Feed (2-A) | Hydrotreated CCN (Ex. 2) |
|---|---|---|
| Total $H_2$ and $C_1$–$C_4$ Hydrocarbons | 27.67 | 33.32 |
| Total Others $C_5$ and Greater | 72.33 | 66.68 |
| SCN, $C_5$-220° C. (430° F.) | 40.85 | 35.79 |
| SCGO, 220–275° C. (430–525° F.) | 7.75 | 12.00 |
| SCT, 275° C. (526° F.) and Above | 23.73 | 18.89 |
| Total | 100.00 | 100.00 |
| Selected Gaseous Products | | |
| Hydrogen | 0.65 | 0.74 |
| Methane | 8.03 | 9.58 |
| Ethane | 1.91 | 2.66 |
| Ethylene | 9.09 | 10.81 |
| Acetylene | 0.08 | 0.09 |
| Propane | 0.07 | 0.07 |
| Propylene | 4.79 | 5.81 |
| Propadiene & Methylacetylene | 0.08 | 0.08 |
| Butane & Isobutane | 0.03 | 0.02 |
| Isobutylene | 0.87 | 0.91 |
| Butene-1 | 0.25 | 0.27 |

TABLE 6-continued

Laboratory Steam Cracking Yields for Gaseous Products Naphtha, Gas Oil, and Tar

| Product Yield wt. % Based on Feedstock | CCN Feed (2-A) | Hydrotreated CCN (Ex. 2) |
|---|---|---|
| Butadiene-1,3 | 1.28 | 1.53 |
| Butene-2 (cis & trans) | 0.32 | 0.43 |
| $C_4$ acetylenes | 0.00 | 0.00 |
| Selected Liguid Products | | |
| Isoprene | 0.00 | 0.35 |
| Pentadiene (cis & trans) | 0.13 | 0.15 |
| Cyclopentadiene | 0.49 | 0.80 |
| methylcyclopentadiene | 0.10 | 0.00 |
| Benzene | 2.79 | 4.03 |

As can be seen in Table 6 above, the yield of each of the particularly valuable steam cracked mono- and diolefin products in the $H_2$ and $C_1$–$C_4$ hydrocarbons fraction, i.e., ethylene, propylene, and butadiene, is increased by at least about 18 percent, the yield of each of the valuable steam cracked diolefin and aromatic products in the steam cracked naphtha fraction, i.e., isoprene, cis-pentadiene, trans-pentadiene, cyclopentadiene, and benzene, is increased by at least about 15 percent, the yield of the steam cracked gas oil product is increased by about 54 percent and the yield of the low value steam cracked tar product is decreased by about 20 percent when the process of the present invention comprising hydrotreating and steam cracking (Example 2) is utilized relative to the yields obtained when the untreated hydrocarbon feed alone is subjected to steam cracking (Comparative Example 2-A).

What is claimed is:

1. An integrated process for converting a hydrocarbon feedstock having components boiling above about 100° C. into steam cracked products, which process comprises:

a) passing said hydrocarbon feedstock in the presence of a hydrogen source and at least two hydrotreating catalysts through a hydrotreating zone at an elevated temperature and a pressure in the range of from about 400 psig and about 1250 psig to effect reduction of the sulfur level to below about 100 parts per million and reduction of the nitrogen level to below about 15 parts per million, wherein the hydrotreating catalysts include a first hydrotreating catalyst comprising a component selected from the group consisting of Group VIB metals, oxides, sulfides, Group VIII metals, oxides, sulfides and mixtures thereof, supported on an amorphous carrier, and a second hydrotreating catalyst comprising a Group VIB component selected from the group consisting of tungsten, molybdenum and mixtures thereof, a Group VIII component selected from the group consisting of nickel, cobalt and mixtures thereof, and a carrier selected from the group consisting of amorphous silica-alumina and molecular sieves having a pore diameter greater than about six angstroms, b) passing the product from said hydrotreating zone to a steam cracking zone wherein said product is contacted with steam at temperatures greater than about 700° C., and c) recovering hydrogen and $C_1$–$C_4$ hydrocarbons, steam cracked naphtha, steam cracked gas oil and steam cracked tar therefrom, wherein the amount of steam cracked tar produced is reduced by at least about 15 percent, basis the starting hydrocarbon feedstock which has not been subject to hydrotreating.

2. The process of claim 1 wherein said hydrocarbon feedstock has components boiling in the range of from about 150° C. to about 650° C.

3. The process of claim 1 wherein in step a), the sulfur level of the hydrocarbon feedstock is reduced to below about 50 parts per million and the nitrogen level of the hydrocarbon feedstock is reduced to below about 5 parts per million.

4. The process of claim 3 wherein in step a), the sulfur level of the hydrocarbon feedstock is reduced to below about 25 parts per million and the nitrogen level of the hydrocarbon feedstock is reduced to below about 3 parts per million.

5. The process of claim 1 wherein said hydrotreating zone in step a) in the second hydrotreating catalyst the carrier is a molecular sieve having a pore diameter greater than about six angstroms admixed with an inorganic oxide binder selected from the group consisting of alumina, silica, silica-alumina and mixtures thereof.

6. The process of claim 1 wherein said first hydrotreating catalyst and said second hydrotreating catalyst are arranged in said hydrotreating zone in a stacked bed configuration.

7. The process of claim 1 wherein said hydrotreating zone in step a) is operated at a temperature ranging from about 200° C. to about 550° C. and a pressure ranging from about 400 psig to about 1,000 psig.

8. The process of claim 1 wherein said hydrotreating zone in step a) is operated at a temperature ranging from about 200° C. to about 550° C. and a pressure ranging from about 400 psig to about 750 psig.

9. The process of claim 1 wherein said steam cracking zone in step b) is operated at a temperature greater than about 700° C. and a coil outlet pressure ranging from about 0 psig to about 75 psig.

10. The process of claim 1 wherein said steam cracking zone in step b) is operated at a temperature ranging from about 700° C. to about 925° C. and a coil outlet pressure ranging from about 0 psig to about 50 psig.

11. The process of claim 1 wherein the yields of ethylene and propylene and butadiene in the $H_2$ and $C_1$–$C_4$ hydrocarbons fraction are each increased by at least about 5 percent, and the yields of isoprene, cis-pentadiene, trans-pentadiene, cyclopentadiene and benzene in the steam cracked naphtha fraction are each increased by at least about 10 percent, basis the hydrocarbon feedstock which has not been subjected to hydrotreating.

12. An integrated process for converting a hydrocarbon feedstock having components boiling above about 100° C. into steam cracked products, which process comprises:

a) passing said hydrocarbon feedstock in the presence of a hydrogen source and a first hydrotreating catalyst through a first hydrotreating zone at an elevated temperature and a pressure in the range of from about 400 psig and about 1,250 psig to reduce the levels of organic sulfur and/or nitrogen compounds contained therein, wherein the first hydrotreating catalyst comprises a component selected from the group consisting of Group VIB metals, oxides, sulfides, Group VIII metals, oxides, sulfides and mixtures thereof, supported on an amorphous carrier, b) passing the product from said first hydrotreating zone to a second hydrotreating zone wherein said product is contacted at a pressure in the range of from about 400 psig and about 1,250 psig and a temperature in the range of from about 200° C. to about 550° C. with a hydrogen source and a second hydrotreating catalyst comprising one or more hydrogenating components selected from the group consisting of Group VIB metals, oxides, sulfides, Group VIII metals, oxides, sulfides and mixtures thereof supported on an acidic carrier, to effect reduction of the sulfur level to below about 100 parts per million and reduction of the nitrogen level to below about 15 parts per million, c) passing the product from said hydrotreating zone to a steam cracking zone wherein said product is contacted with steam at temperatures greater than about 700° C., and d) recovering hydrogen and $C_1$–$C_4$ hydrocarbons, steam cracked naphtha, steam cracked gas oil and steam cracked tar therefrom, wherein the amount of steam cracked tar produced is reduced by at least about 15 percent, basis the starting hydrocarbon feedstock which has not been subject to hydrotreating wherein the yields of ethylene and propylene and butadiene in the $H_2$ and $C_1$–$C_4$ hydrocarbons fraction are each increased by at least about 5 percent, and the yields of isoprene, cis-pentadiene, trans-pentadiene, cyclopentadiene and benzene in the steam cracked naphtha fraction are each increased by at least about 10 percent, basis the hydrocarbon feedstock which has not been subjected to hydrotreating.

13. The process of claim 12 wherein said hydrocarbon feedstock has components boiling in the range of from about 150° C. to about 650° C.

14. The process of claim 12 wherein in step a), the sulfur level of the hydrocarbon feedstock is reduced to below about 500 parts per million and the nitrogen level of the hydrocarbon feedstock is reduced to below about 50 parts per million.

15. The process of claim 14 wherein in step a), the sulfur level of the hydrocarbon feedstock is reduced to below about 200 parts per million and the nitrogen level of the hydrocarbon feedstock is reduced to below about 25 parts per million.

16. The process of claim 12 wherein said first hydrotreating zone in step a) is operated at a temperature ranging from about 200° C. to about 550° C. and a pressure ranging from about 400 psig to about 1,000 psig.

17. The process of claim 12 wherein said second hydrotreating catalyst in step b) comprises a Group VIB component selected from the group consisting of tungsten, molybdenum and mixtures thereof, a Group VIII component selected from the group consisting of nickel, cobalt and mixtures thereof, and a carrier selected from molecular sieves having a pore diameter greater than about six angstroms admixed with an inorganic oxide binder selected from the group consisting of alumina, silica, silica-alumina and mixtures thereof.

18. The process of claim 17 wherein the Group VIII component is nickel, the Group VIB component is selected from the group consisting of molybdenum, tungsten and mixtures thereof, the molecular sieve is zeolite Y and the binder is alumina.

19. The process of claim 12 wherein in step b), the sulfur level of the hydrocarbon feedstock is reduced to below about 50 parts per million and the nitrogen level of the hydrocarbon feedstock is reduced to below about 5 parts per million.

20. The process of claim 19 wherein in step b), the sulfur level of the hydrocarbon feedstock is reduced to below about 25 parts per million and the nitrogen level of the hydrocarbon feedstock is reduced to below about 3 parts per million.

21. The process of claim 12 wherein said second hydrotreating zone in step b) is operated at a temperature ranging from about 200° C. to about 550° C. and a pressure ranging from about 400 psig to about 1,000 psig.

22. The process of claim 12 wherein said steam cracking zone in step c) is operated at a temperature greater than about 700° C. and a coil outlet pressure ranging from about 0 psig to about 75 psig.

23. The process of claim 12 wherein said steam cracking zone in step c) is operated at a temperature ranging from about 700° C. to about 925° C. and a coil outlet pressure ranging from about 0 psig to about 50 psig.

* * * * *